US008939738B2

(12) United States Patent
Beers et al.

(10) Patent No.: US 8,939,738 B2
(45) Date of Patent: Jan. 27, 2015

(54) THRUST BEARING SHAFT FOR FAN

(75) Inventors: Craig M. Beers, Wethersfield, CT (US); Lawrence Binek, Windsor, CT (US); Valentina Lugo, San Francisco, CA (US)

(73) Assignee: Hamilton Sundstrand Corporation, Windsor Locks, CT (US)

( * ) Notice: Subject to any disclaimer, the term of this patent is extended or adjusted under 35 U.S.C. 154(b) by 330 days.

(21) Appl. No.: 13/421,893

(22) Filed: Mar. 16, 2012

(65) Prior Publication Data

US 2013/0243619 A1 Sep. 19, 2013

(51) Int. Cl.
*F04D 29/051* (2006.01)

(52) U.S. Cl.
CPC ..... *F04D 29/051* (2013.01)
USPC ..... 417/423.12; 415/104; 384/107

(58) Field of Classification Search
CPC ..... F04D 29/04; F04D 29/05; F04D 29/053; F04D 29/58; F04D 29/46; F04D 29/051; F04D 29/054
USPC ..... 417/366; 384/107
See application file for complete search history.

(56) References Cited

U.S. PATENT DOCUMENTS 6,236,184 B1 5/2001 Baker
7,342,332 B2 * 3/2008 McAuliffe et al. ..... 310/58
7,394,175 B2 * 7/2008 McAuliffe et al. ..... 310/58
7,557,479 B2 7/2009 Yeh et al.
7,671,499 B2 3/2010 Lan et al.
7,695,355 B2 4/2010 Doherty
7,712,963 B2 5/2010 Lin et al.
7,757,502 B2 * 7/2010 Merritt et al. ..... 62/172
7,922,447 B2 4/2011 Kao
8,057,173 B2 11/2011 Chen
8,066,472 B2 11/2011 Coffin et al.
8,075,274 B2 12/2011 Carvalho

* cited by examiner

*Primary Examiner* — Charles Freay
*Assistant Examiner* — Philip Stimpert
(74) *Attorney, Agent, or Firm* — Carlson, Gaskey & Olds, PC

(57) ABSTRACT

A thrust shaft for a fan has a shaft body with an enlarged disk adjacent one axial end to provide a rotating surface in a pair of thrust bearings. A first cylindrical portion extends from the disk in a first direction, and a second cylindrical portion extending from the disk in a second opposed direction. The second cylindrical portion has a hollow bore, and there are a plurality of holes extending through the second cylindrical portion to communicate an outer periphery with the bore. A ratio of the diameter of the bore to a diameter of the plurality of air holes is between 6.60 and 7.00. A ratio of an overall length of the second cylindrical portion, and a distance from a face of the enlarged disk to a center of the holes is between 14.4 and 15.2. A thrust bearing assembly, a fan, a cabin air supply system, and a method are also disclosed.

12 Claims, 2 Drawing Sheets

THRUST BEARING SHAFT FOR FAN

BACKGROUND OF THE INVENTION

This application relates to a thrust bearing shaft for a fan, wherein the thrust bearing shaft is designed to distribute air between two axial thrust bearing surfaces, and a radial thrust bearing.

Fans are known, and utilized in any number of applications. In one application, an electric motor drives a fan rotor. A thrust bearing may position the fan axially at a desired location. One known type of thrust bearing passes air along two opposed surfaces on opposed faces of a thrust bearing shaft disc to position the fan rotor axially. The air then passes through openings in a shaft portion, and may pass across a radial thrust bearing.

In the prior art, air has not always been adequately distributed as desired.

One application for such a fan is as part of a cooling system for supplying air to an aircraft cabin. In such systems, a fan delivers air across heat exchangers which are in turn utilized to cool air being sent into the aircraft cabin, or being sent to cool aircraft galleys.

SUMMARY OF THE INVENTION

A thrust shaft for a fan has a shaft body with an enlarged disk adjacent one axial end to provide a rotating surface in a pair of thrust bearings. A first cylindrical portion extends from the disk in a first direction, and a second cylindrical portion extending from the disk in a second opposed direction. The second cylindrical portion has a hollow bore, and there are a plurality of holes extending through the second cylindrical portion to communicate an outer periphery with the bore. A ratio of the diameter of the bore to a diameter of the plurality of air holes is between 6.60 and 7.00. A ratio of an overall length of the second cylindrical portion, and a distance from a face of the enlarged disk to a center of the holes is between 14.4 and 15.2.

A thrust bearing assembly, a fan, a cabin air supply system, and a method are also disclosed.

These and other features of the invention will be better understood from the following specifications and drawings, the following of which is a brief description.

DETAILED DESCRIPTION

Figure 1:
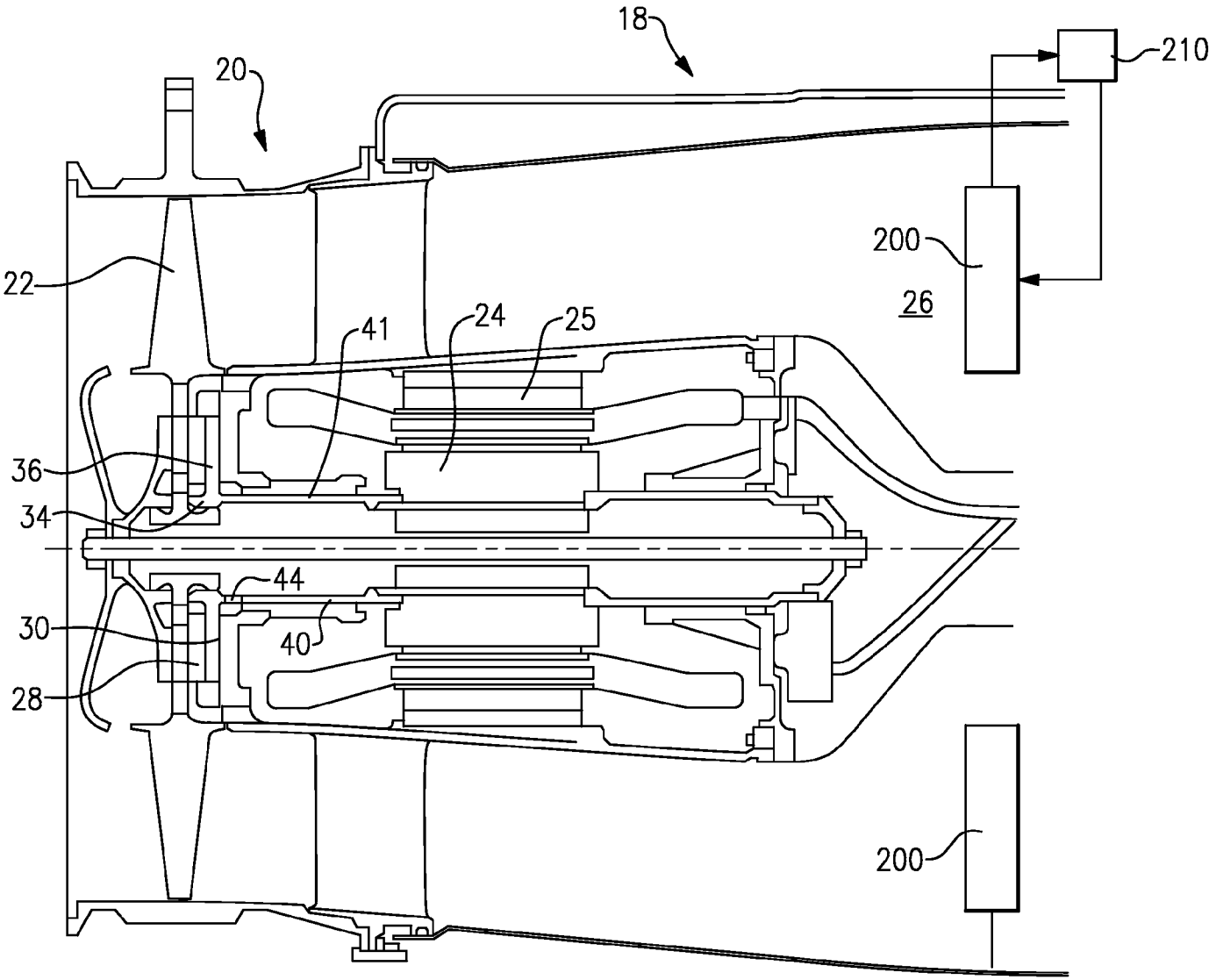
FIG. 1 schematically shows an aircraft air supply system.

An aircraft air supply system 18 incorporates a fan 20 including a fan rotor 22 which is driven by a motor having a motor rotor 24 and stator 25. The fan 20 delivers air into a cooling duct 26. Air from the duct 26 is shown passing over heat exchangers 200. The heat exchangers 200 may be part of an air supply system 210 for supplying air into an aircraft cabin. The actual location of the heat exchangers 210 may be different than what is illustrated in this figure, however, this figure is intended to schematically show the use of the fan 20 as a source of cooling for the air supply system 210.

The fan 20 has a pair of thrust bearing surfaces 28 and 30 spaced about a disk portion 36 of a thrust bearing shaft 34.

Thrust bearing shaft 34 rotates with the motor rotor 24. Thrust bearing shaft 34 has air holes 44 to deliver air from the axial bearing surface faces on the disk 36 to a radial thrust bearing 41.

Figure 2:
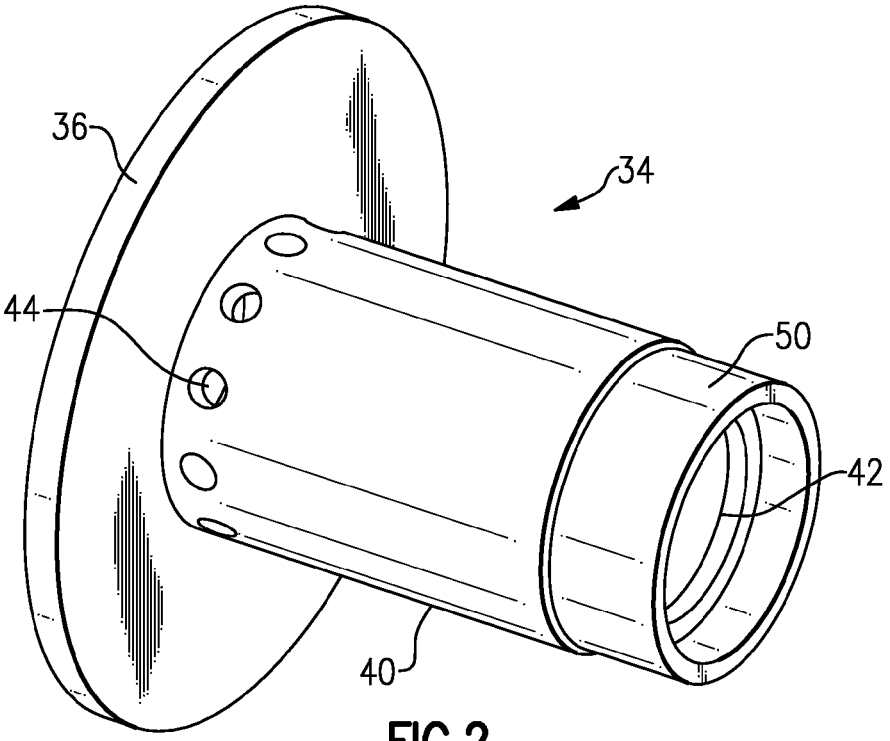
FIG. 2 is a perspective view of the thrust bearing shaft of this application.

FIG. 2 shows a detail of an exemplary embodiment of the thrust bearing shaft 34 including a generally cylindrical disk 36, a plurality of air holes 44, shaft portion 40 and a bore 42 extending through the shaft portion 40 (i.e., bore 42 is longitudinally coextensive with shaft portion 42).

In one embodiment, there are eleven holes 44 spaced by equal angles circumferentially about a centerline of the bore 42. Thus, the holes 44 would be spaced by an angle of about 32.7 degrees.

Figure 3:
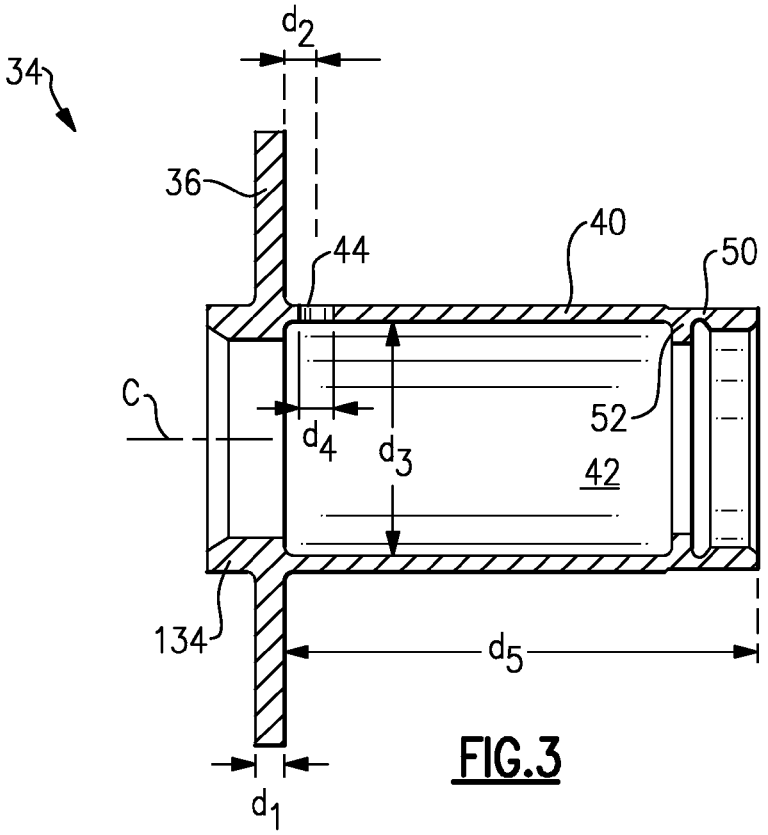
FIG. 3 is a cross-section through the thrust bearing shaft of this application.

FIG. 3 is a cross-sectional view of the shaft 34. As shown, a forward hub 134 extends in one direction from the disk 36, while the cylindrical portion 40 extends in the opposed direction to a radially smaller outer end 50. Inward of the outer end 50 is a step 52.

The disk 36 extends along an axial distance of $d_1$. Axial distances are measured along a centerline, or rotational axis C. In one embodiment, $d_1$ was about 0.200 inches (about 0.508 cm). A distance $d_2$ can be defined from an adjacent face of the disk 36 to a center of the holes 44. In one embodiment, $d_2$ was about 0.23 inches (about 0.58 cm). The bore 42 extends across a diameter $d_3$, at least at a location aligned with the holes 44. In one embodiment, $d_3$ was about 1.70 inches (about 4.31 cm). The holes 44 have a diameter $d_4$ which in one embodiment was about 0.25 inches (about 0.64 cm). An overall length of the combined portions 40 and 50 is $d_5$ and in one embodiment was about 3.41 inches (about 8.66 cm).

In embodiments, a ratio of $d_5$ to $d_2$ was between 14.4 and 15.2; a ratio of $d_1$ to $d_2$ is between 0.82 and 0.92; and a ratio of $d_3$ to $d_4$ is between 6.60 and 7.00.

A method of assembling a fan includes inserting a thrust shaft body to rotate with a motor rotor, and wherein the rotor drives a fan. The thrust shaft body has structure as disclosed. The thrust shaft body is secured to rotate with a motor rotor and a fan rotor, and positioned to be intermediate two housing portions, with the two housing portions each defining thrust bearing surfaces in combination with the enlarged disk on the thrust shaft body.

Although an embodiment of this invention has been disclosed, a worker of ordinary skill in this art would recognize that certain modifications would come within the scope of this invention. For that reason, the following claims should be studied to determine the true scope and content of this invention.

What is claimed is:

1. A thrust shaft for a fan comprising:

a shaft body having an enlarged disk adjacent one axial end to provide a rotating surface for a pair of thrust bearings;

a first cylindrical portion extending from said disk in a first direction, and a second cylindrical portion extending from said disk in a second opposed direction, said second cylindrical portion having a hollow bore, and there being a plurality of holes extending through said second cylindrical portion to communicate an outer periphery of said second cylindrical portion with said hollow bore, with a ratio of a diameter of said hollow bore of said second cylindrical portion to a diameter of said plurality of holes being between 6.60 and 7.00;

a ratio of an overall length of said second cylindrical portion, and a distance from a face of said enlarged disk to a center of said holes being between 14.4 and 15.2;

said enlarged disk extending for an axial thickness, and a spacing distance being defined from said face to a center of said holes, with a ratio of said thickness to said spacing distance being between 0.82 and 0.92; and said diameter of said hollow bore being taken at an axial location aligned with said holes.

2. The shaft as set forth in claim 1, wherein there are eleven of said holes spaced equally about a circumference of said second cylindrical portion.

3. A thrust bearing assembly comprising:

a pair of thrust bearing members;

a thrust shaft body positioned between said thrust bearing members and having an enlarged disk adjacent one axial end to provide a rotating surface;

a first cylindrical portion extending from said enlarged disk in a first direction, and a second cylindrical portion extending from said enlarged disk in a second opposed direction, said second cylindrical portion having a hollow bore, and there being a plurality of holes extending through said second cylindrical portion to communicate an outer periphery of said second cylindrical portion with said hollow bore, with a ratio of a diameter of said hollow bore of said second cylindrical portion to a diameter of said plurality of holes being between 6.60 and 7.00;

a ratio of an overall length of said second cylindrical portion, and a distance from a face of said enlarged disk to a center of said holes being between 14.4 and 15.2;

said enlarged disk extending for an axial thickness, and a spacing distance being defined from said face to a center of said holes, with a ratio of said thickness to said spacing distance being between 0.82 and 0.92; and said diameter of said hollow bore being taken at an axial location aligned with said holes.

4. The thrust bearing assembly as set forth in claim 3, wherein there are eleven of said holes spaced equally about a circumference of said second cylindrical portion.

5. A fan for use in a cabin air supply for an aircraft comprising:

a motor driving a rotor, said rotor driving a fan rotor;

a housing enclosing said motor, and said fan rotor, and said housing having two opposed housing portions each providing air thrust bearing surfaces;

a shaft body rotating with said rotor, and having an enlarged disk adjacent one axial end to provide a rotating surface in a thrust bearing and positioned between said two opposed housing portions;

a first cylindrical portion extending from said disk in a first direction, and a second cylindrical portion extending from said enlarged disk in a second opposed direction, said second cylindrical portion having a hollow bore, and there being a plurality of holes extending through said second cylindrical portion to communicate an outer periphery of said second cylindrical portion with said hollow bore, with a ratio of a diameter of said hollow bore of said second cylindrical portion to a diameter of said plurality of holes being between 6.60 and 7.00;

an overall length of said second cylindrical portion being a third distance, and a distance from a face of said enlarged disk to a center of said holes being a fourth distance, with a ratio of said third distance to said fourth distance being between 14.4 and 15.2;

said enlarged disk extending for an axial thickness, and a spacing distance being defined from said face to a center of said holes, with a ratio of said thickness to said spacing distance being between 0.82 and 0.92; and said diameter of said hollow bore being taken at an axial location aligned with said holes.

6. The fan as set forth in claim 5, wherein there are eleven of said holes.

7. The fan as set forth in claim 6, wherein said eleven of said holes are spaced equally about a circumference of said second cylindrical portion.

8. A cabin air supply system for an aircraft comprising:

at least one heat exchanger for cooling air to be delivered into an airplane cabin;

a fan including a motor driving a rotor, said rotor driving a fan rotor, a housing enclosing said motor, and said fan rotor, and said housing having two opposed housing portions each providing air thrust bearing surfaces, a shaft body rotating with said rotor, and having an enlarged disk adjacent one axial end to provide a rotating surface in a thrust bearing and positioned between said two opposed housing portions, a first cylindrical portion extending from said enlarged disk in a first direction, and a second cylindrical portion extending from said enlarged disk in a second opposed direction, said second cylindrical portion having a hollow bore, and there being a plurality of holes extending through said second cylindrical portion to communicate an outer periphery of said second cylindrical portion with said hollow bore, with a ratio of a diameter of said hollow bore of said second cylindrical portion to a diameter of said plurality of holes being between 6.60 and 7.00, and an overall length of said second cylindrical portion being a third distance, and a distance from a face of said enlarged disk to a center of said holes being a fourth distance, with a ratio of said third distance to said fourth distance being between 14.4 and 15.2;

said enlarged disk extending for an axial thickness, and a spacing distance being defined from said face to a center of said air holes, with a ratio of said thickness to said spacing distance being between 0.82 and 0.92; and said diameter of said hollow bore being taken at an axial location aligned with said holes.

9. The system as set forth in claim 8, wherein there are eleven of said holes.

10. The system as set forth in claim 9, wherein said eleven of said holes are spaced equally about a circumference of said second cylindrical portion.

11. A method of assembling a fan comprising the steps of:

inserting a thrust shaft body having an enlarged disk adjacent one axial end, a first cylindrical portion extending from said disk in a first direction, and a second cylindrical portion extending from said disk in a second opposed direction, said second cylindrical portion having a hollow bore, and there being a plurality of holes extending through said second cylindrical portion to communicate an outer periphery of said second cylindrical portion with said hollow bore, with a ratio of a diameter of said hollow bore of said second cylindrical portion to a diameter of said plurality of holes being between 6.60 and 7.70, a ratio of an overall length of said second cylindrical portion, and a distance from a face of said enlarged disk to a center of said holes being between 14.4 and 15.2, said enlarged disk extending for an axial thickness, and a spacing distance being defined from said face to a center of said holes, with a ratio of said thickness to said spacing distance being between 0.82 and 0.92 said diameter of said hollow bore being taken at an axial location aligned with some plurality of holes; and securing said thrust shaft body to rotate with a motor rotor, and positioning said enlarged disk to be intermediate two housing portions, with said two housing portions each defining thrust bearing surfaces in combination with said enlarged disk.

12. The method of assembling a fan as set forth in claim 11, wherein there are eleven of said holes spaced equally about a circumference of said second cylindrical portion.

* * * * *